US008242438B2

(12) United States Patent
Senko

(10) Patent No.: US 8,242,438 B2
(45) Date of Patent: Aug. 14, 2012

(54) CORRECTION OF TIME OF FLIGHT SEPARATION IN HYBRID MASS SPECTROMETERS

(75) Inventor: Michael W. Senko, Sunnyvale, CA (US)

(73) Assignee: Thermo Finnigan LLC, San Jose, CA (US)

( * ) Notice: Subject to any disclaimer, the term of this patent is extended or adjusted under 35 U.S.C. 154(b) by 387 days.

(21) Appl. No.: 11/777,926

(22) Filed: Jul. 13, 2007

(65) Prior Publication Data

US 2009/0014647 A1 Jan. 15, 2009

(51) Int. Cl.
*H01J 49/40* (2006.01)

(52) U.S. Cl. ..... 250/282; 250/281; 250/283; 250/287

(58) Field of Classification Search ..... 250/281, 250/282, 287, 288, 290, 293, 294, 296, 295, 250/286, 283

See application file for complete search history.

(56) References Cited

U.S. PATENT DOCUMENTS

| | | | | |
|---|---|---|---|---|
| 7,071,464 | B2 * | 7/2006 | Reinhold | 250/282 |
| 2002/0145109 | A1 * | 10/2002 | Doroshenko | 250/287 |
| 2003/0222214 | A1 * | 12/2003 | Baba et al. | 250/292 |
| 2004/0232327 | A1 * | 11/2004 | Bateman et al. | 250/288 |
| 2005/0139760 | A1 * | 6/2005 | Wang et al. | 250/281 |
| 2006/0016979 | A1 * | 1/2006 | Yang et al. | 250/288 |
| 2008/0156980 | A1 * | 7/2008 | Rather et al. | 250/287 |

FOREIGN PATENT DOCUMENTS

| | | |
|---|---|---|
| GB | 440658 | 2/2008 |
| WO | WO 2004/081968 A2 | 9/2004 |

* cited by examiner

*Primary Examiner* — David A Vanore
*Assistant Examiner* — Nicole Ippolito
(74) *Attorney, Agent, or Firm* — David E. Allred; Charles B. Katz; Pamela Lau Kee

(57) ABSTRACT

The present invention pertains to a method and apparatus which increases the efficiency with which ions are transported from a first ion trap to a second ion trap, and subsequently trapped in the second ion trap. In one aspect the invention, increased efficiency takes the form or enabling ions of both high and low mass to charge ratios to be trapped in the second ion trap at substantially the same time, or at least within a relatively small window of time. This can be achieved by minimizing the undesirable time-of-flight separation by the high and low mass to charge ratio ions as they are transported from a first ion trap to the second ion trap. This minimization can be realized by adjusting the potential energy applied to ion transfer optics disposed between the two ion traps.

10 Claims, 3 Drawing Sheets

CORRECTION OF TIME OF FLIGHT SEPARATION IN HYBRID MASS SPECTROMETERS

FIELD OF THE INVENTION

The present invention relates to a spectrometer, and a method of mass spectrometry.

BACKGROUND OF THE INVENTION

High resolution mass spectrometry is widely used in the detection and identification of molecular structures and the study of chemical and physical processes. A variety of different techniques are known for the generation of a mass spectrum using various trapping and detection methods. Once such technique is Fourier Transform Ion Cyclotron Resonance (FTICR). FTICR's use the principle of a cyclotron, wherein a high frequency voltage excites ions to move in a spiral within an ICR cell. The ions in the cell orbit as coherent bunches along the same radial paths but at different frequencies. The frequency of the circular motion is inversely proportional to the ion mass.

The coupling of a linear ion trap with a Fourier Transform Ion Cyclotron Resonance (FTICR) mass spectrometer was introduced to separate the ion production region from the ion detection region of the FTICR. The combination of the two ion traps provides a powerful combination which can produce high sensitivity, high mass accuracy, and high resolution in an easy to use package. One undesirable aspect of this combination however is the problems associated with transferring ions from the linear ion trap to the FTICR cell. Due to vacuum requirements and the location of the FTICR cell in the center of a superconducting magnet, the ion transfer distance is typically a meter or more.

Ions are normally released from the linear trap with a fixed amount of kinetic energy (~1V), and the DC offset of all ion optics are held static during the transfer. This means that the velocity of an ion will be mass-to-charge (m/z) dependent, and in a MS mode of operation, only ions having substantially the same mass to charge ratio or ions having a relatively narrow range of mass to charge ratios will enter the FTICR at substantially the same time. The gated trapping mechanism most commonly used for FTICR is able to only catch a ~100 microsecond window of ions, which leads to transfer time dependent ion abundances. With short transfer times, low m/z ions are favored, while at long transfer times high m/z ions are favored. Higher energy ions arrive at the detector ahead of lower energy ions having the same mass. This spreading of flight times limits the mass range of the spectrometer.

It is desired to provide an improved mass spectrometer and in particular a mass spectrometer which enables ions with a wide range of m/z values to be trapped in a FTICR without compromising the results attained from use of such a mass spectrometer.

SUMMARY

A broad form of the present invention pertains to a method and apparatus which increases the efficiency with which ions are transported from a first ion trap to a second ion trap, and subsequently trapped in the second ion trap.

In one aspect the invention, increased efficiency takes the form or enabling ions of both high and low mass to charge ratios to be trapped in the second ion trap at substantially the same time, or at least within a relatively small window of time. In another aspect of the invention, this can be achieved by minimizing the undesirable time-of-flight separation by the high and low mass to charge ratio ions as they are transported from a first ion trap to the second ion trap. In yet another aspect of the present invention, this minimization is realized by adjusting the potential energy applied to ion transfer optics disposed between the two ion traps.

The adjustment of the potential energy may be fully or partially defined as linear or non-linear. The adjustment of the potential energy may be applied over a period of time, and may comprise different variations over different periods of time.

BRIEF DESCRIPTION OF THE DRAWINGS

Like reference numerals refer to corresponding parts throughout the several views of the drawings.

DETAILED DESCRIPTION OF EMBODIMENTS

An illustrative embodiment of the present invention is described herein. However, configurations, systems and operation in accordance with the present invention may be embodied in a variety of forms, some of which may be different from those disclosed herein. The specific structural and functional details disclosed herein are merely representative, and provide a basis for the claims herein which define the scope of the present invention. The following present a detailed description on an embodiment of the present invention, as well as some alternative embodiments.

Figure 1:
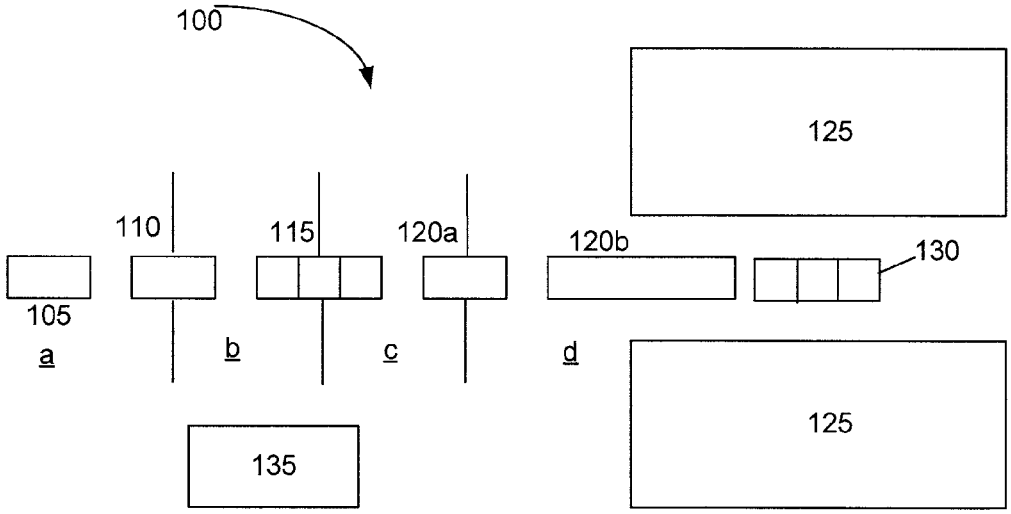
FIG. 1 is a schematic representation of a Fourier Transform Ion Cyclotron Resonance Mass Spectrometer system.

FIG. 1 is a symbolic diagram depicting an overall configuration of a Fourier Transform Ion Cyclotron Resonance Mass Spectrometer (FTICR-MS) system 100 in which techniques of the present invention may be implemented. Ions generated by an ion source 105 are injected directly or indirectly into a first ion trap 115. The ion source 105, which can be any conventional ion source such as an electrospray ionization source (ESI), APCI (atmospheric pressure chemical ionization), APPI (atmospheric pressure photo-ionization), APPCI (atmospheric pressure photo-chemical-ionization), MALDI (matrix assisted laser desorption ionization), AP-MALDI (atmospheric pressure-MALDI), EI (electron impact ionization), CI (Chemical Ionization), FAB (Fast Atom Bombardment), and SIMS (Secondary Ion Mass Spectrometry). Although ion source 105 is depicted as being coaxial with first ion trap 115, an orthogonal arrangement or other configurations may be used.

A system of ion transfer optics 110, which may include for example various multipole ion guides and lenses, transfers and/or focuses the generated ions through one or more pumping regions (a, b) such that they arrive at first ion trap 115 in a reduced pressure region if required. The differential pumping stages a, b, c, and mass analysis region d are connected to one or more vacuum pumps (i.e., a roughing pump and/or turbo pump having a drag stage and a main stage). Such systems are known in the art and will not be discussed further.

The first ion trap 115 functions to accumulate ions generated by or derived from the ion source 105. The first ion trap 115 can be, for example, in the form of a multipole ion guide, such as a RF quadrupole ion trap or a RF linear multipole ion trap, a RF ion tunnel or any other storage type device. In the case of an RF quadrupole or linear ion trap, the range and efficiency of ion mass to charge ratios (m/z's) captured in the ion trap may be controlled by, for example, selecting the RF and DC voltages used to generate the quadrupole potential, or applying supplementary fields, e.g. broadband waveforms. A collision or damping gas preferably can be introduced into the ion trap in order to enable efficient collisional stabilization of the ions injected into the first ion trap 115. According to an aspect of the present invention, the ions in the first ion trap 115 can be manipulated before being transferred to a second trap, the first ion trap functioning to select desired ions and reject unwanted ions. Thus, ions in a predetermined range of m/z may be selected. Embodiments of the present invention are effective in manipulating ions having a broad range of m/z values. A range from a minimum m/z to two or more times the minimum m/z is within the spirit and scope of the invention. For example, an upper end of the range may be from approximately two to approximately ten or more times the minimum m/z of the range. On the other hand, the embodiments of the present invention may be applied to narrower ranges that are less than two times the minimum m/z value. For example, ions in a range from a minimum m/z to an m/z that is one hundred and thirty or one hundred and forty percent of the minimum value may be manipulated and analyzed. Further alternatively, the range of ions to be trapped may be from one hundred to one hundred twenty percent of a predetermined minimum m/z value.

Once sufficient ions have been accumulated, and the appropriate selection and rejection of ions has taken place, ions are then extracted or ejected from the first ion trap 115 via a gate electrode and pass through further ion transfer optics 120 (comprising for example a combination of short (120*a*) and long (120*b*) multipole ion guides and lenses) which guide and/or focus and/or accelerate the ions through the magnetic fields generated by the superconducting magnets 125 of the FTICR-MS and into a second ion trap 130, for example an FTICR cell, for analysis. In an alternative configuration of the present invention, the FTICR cell 130 can take the form of any conventional trapping-type ion mass spectrometer, such as a three-dimensional quadrupole ion trap, a RF linear quadrupole ion trap, or an electrostatic ion trap (such as an orbitrap), for example.

Some or all of the components of system 100 can be coupled to a system control unit, such as an appropriately programmed digital computer 135, which receives and processes data from the various components and which can be configured to perform analysis on data received.

Ions are typically released from the first ion trap 115 with a fixed amount of kinetic energy (approximately 1V), and the DC offsets of all ion transfer optics and lenses are held static during the transfer. Since the velocity of the ions is mass to charge ratio (m/z) dependent the transfer time can vary from a few hundred microseconds to several milliseconds, depending upon the range of m/z values being transferred. The gated trapping mechanism most commonly used for FTICR is able to only provide approximately a hundred microsecond window of ions, which leads to transfer time dependent ion abundances. With short transfer times, low m/z ions are favored, while at long transfer times high m/z ions are favored. As a consequence a broad range of ions cannot be transferred to the FTICR cell within the window of opportunity, thus limiting the use of the entire FTICR system.

According to an aspect of the present invention, a system which increases the efficiency with which ions are transported from the linear ion trap 115 to the FTICR cell 130, and are subsequently trapped in the FTICR cell, is provided. One way of achieving this is to minimize the undesirable time-of-flight separation of ions as they are transported from the linear ion trap 115 to the FTICR cell 130.

Figure 2:
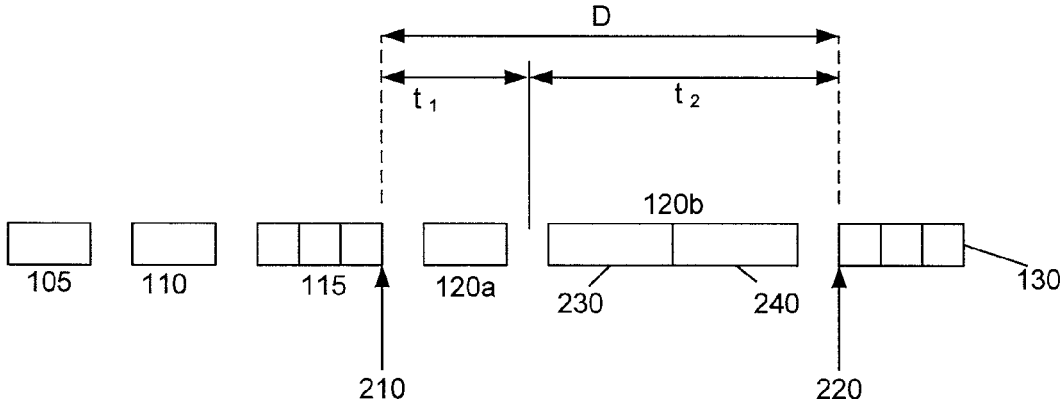
FIG. 2 illustrates the distance between the two ion traps in accordance with an aspect of the invention.

FIG. 2 shows the same elements as FIG. 1, but with the magnets 125 removed (for simplicity). It can be seen that the exit 210 of the first ion trap 115 is separated from the entrance 220 of the second ion trap 130 by a distance D. Disposed within this distance is the ion transfer optics 120, which as illustrated comprises a short multipole ion guide 120*a* and a long multipole ion guide 120*b*. In order to practice embodiments of the present invention, the ions may be provided with some initial time-of-flight separation. Ions of different mass to charge ratios can initially be temporally separated from each other to some degree. That is, they can be separated such that they do not all travel as a "bunch". To facilitate the needed separation, ions travel for a time $t_1$ over a first section of the distance D, corresponding to a time $t_1$. During this time $t_1$ the ions are allowed to continue with the kinetic energy they had on leaving the first ion trap 115. Since higher mass to charge ratios have lower velocities, the lower mass to charge ratio ions will move further than the higher mass to charge ratio ions. A time-of-flight separation will result, as illustrated schematically by circles representing ions, smaller ones of which have moved further to the right in FIG. 3.

The embodiments of the present invention provide a method and an apparatus for increasing the ion trapping efficiency by reducing the time-of-flight separation between the lower and the higher mass to charge ratio ions. A method and apparatus for reducing the time-of-flight separation is described herein with reference to the flowchart of FIG. 4 in combination with the FIGS. 2 and 3 schematics. In the initial step illustrated, ions are generated from the source 105 and subsequently accumulated in the first ion trap 115 (step 410). In the next step 420, the ions are extracted or ejected from the first ion trap 115 and allowed to travel for a sufficient time $t_1$ over a first segment of a distance D to separate according to their mass to charge ratio in step 430. The ions leave the first segment of the distance D (after time $t_1$ and enter a second segment of the distance D corresponding to $t_2$, in which a mass to charge ratio dependent potential energy is applied (step 440) to the ions.

Figure 3:
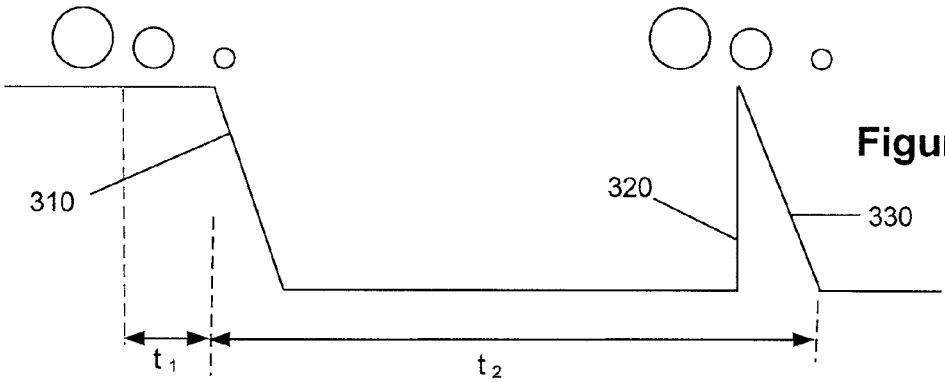
FIG. 3 illustrates a linear potential energy profile along various segments of the mass spectrometer in accordance with an aspect of the invention.
Figure 4:
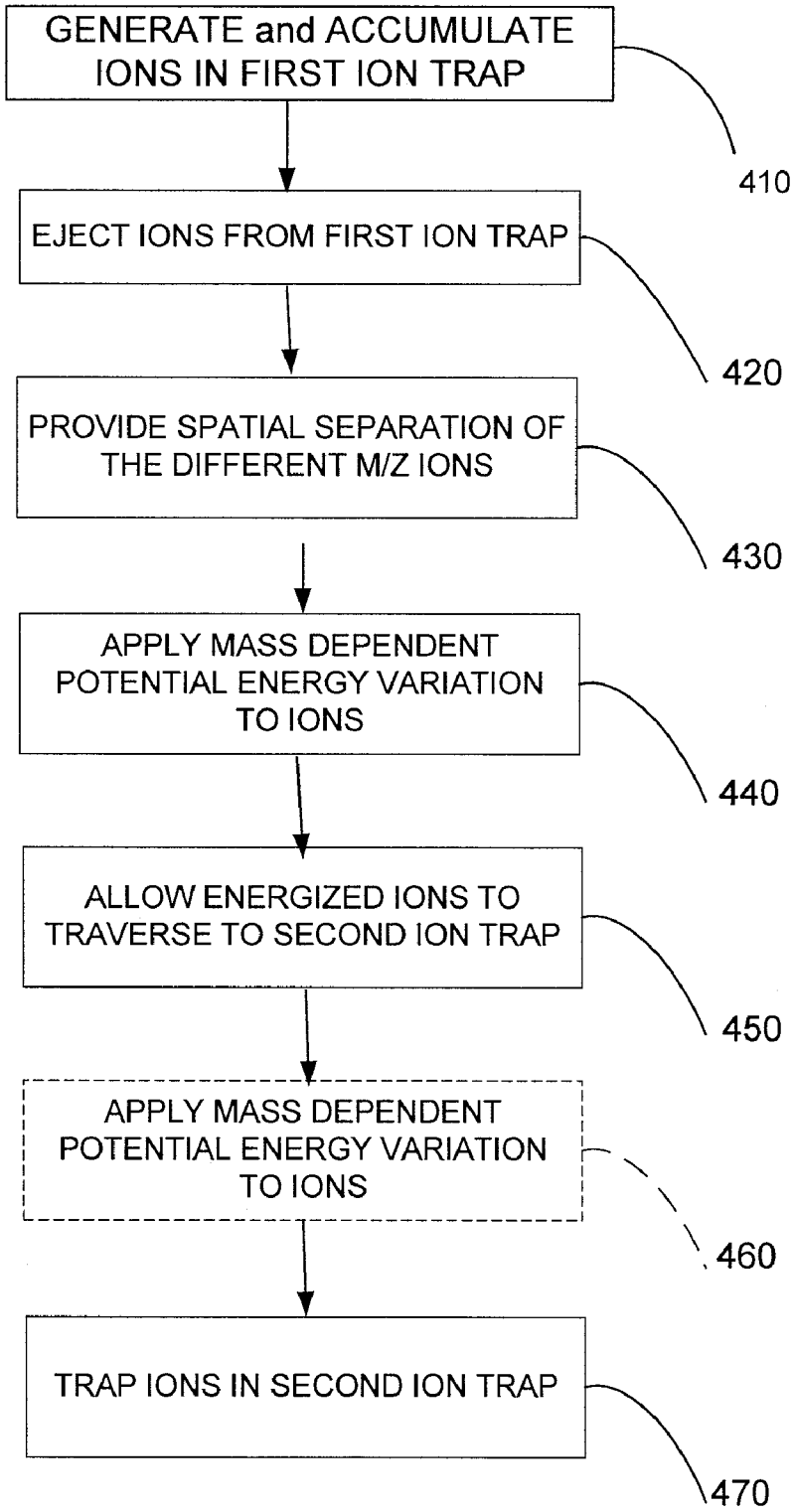
FIG. 4 is a flow diagram illustrating a method of the present invention in accordance to another aspect of the invention.

FIG. 3 is an electrical potential energy versus time diagram of the electrical potential applied to the ion transfer optics 120*b* for urging ions, assuming the ions of interest entering the device 120*b* are positive ions. Thus, a slope downward to the right represents a negative voltage ramp over a period of time. Since the ions have been permitted to separate for the sufficient period of time $t_1$ prior to the ramping indicated by the potential energy signal adjustment (310), the ions will arrive in increasing mass order at a portion of the ion transfer optics, (between the short multipole 120*a* and the long multipole 120*b* for example), to which the ramping voltage difference is applied. (This assumes that the ions are singly charged ions.) The ramping may be started at a time that corresponds to when the lower mass ions are influenced by the voltage on the long multipole 120*b*. The ramp may be applied during a period corresponding to the entry of the rest of the ions to be analyzed into a region of influence where they are likewise influenced by the voltage on the long multipole 120*b* during ramping of the potential energy signal adjustment (310). Thus, the ions will receive an increasingly larger amount of kinetic energy during the ramping period. Therefore, the larger mass ions will receive more energy than the smaller mass ions during the ramping. Once inside the long multipole 120*b*, the ions are unaffected by changes in the potential energy until the ions are about to leave the long multipole 120*b*. Thus, it is possible to deliver greater energy to larger mass ions and lesser energy to smaller mass ions so that they will have similar velocities during their passage through the long multipole 120*b*.

As illustrated in FIGS. 2 and 3, during the second segment of their journey, (over time $t_2$), the potential energy signal adjustment (310) may be in the form of a DC negative offset applied to the long multipole 120*b* and ramped down relative to the short multipole 120*a*. (Alternatively, the potential energy signal adjustment for positive ions may be in the form of a positive offset applied to the short multipole 120*a* and ramped up relative to the long multipole 120*b* of the ion optics 120.) The goal is to generally equalize the velocities of the ions of interest so that they are inhibited from further physical separation from each other such that more of the ions can enter the ion gate of the FTICR. It is noted that the short multipole 120*a* of the ion optics in FIG. 2 is closer to the first ion trap 115 such that the ions are permitted to separate over a sufficient yet short distance during period of time $t_1$. At some position within the short multipole 120*a* or upon exiting the short multipole 120*a* during ion transport, the ions are influenced by the potential difference applied to the long multipole 120*b*. The timing and wave form of the potential energy signal adjustment or ramp may be selected to deliver a precise amount of energy to each of the ions on a mass dependent basis. The wave form of the ramp is shown at 310 in FIG. 3 as being linear such that the potential energy signal adjustment (310) gives positive ions of lower m/z lower kinetic energy and positive ions of higher m/z additional kinetic energy (step 450). The timing of the ramp provides energy to respective ones of the ions at precise instants when the ions are in a region of potential energy influence between the short multipole 120*a* and the long multipole 120*b*. In the illustrated example of FIG. 3, while traveling axially along a remainder of the ion transfer optics 120 (which makes up a majority of a length of the ion transfer optics), the now energized ions may travel at substantially the same velocity and may be substantially unaffected by any field variation since, in this embodiment, the entire long multipole is at the same potential. Thus, as may be appreciated, a time-of-flight focusing effect may be produced by this or other techniques of the present invention. These techniques may be used to increase the number of ions that can be received through the ion gate to the FTICR and thus reduce the transfer time dependent lower ion abundances of the past.

The step of generally equalizing the velocity of the ions of interest along a majority of the ion transfer optics 120 may be expressed in terms of the kinetic energy and the mass of the ions. Kinetic energy is proportional to the mass of an ion and the square of the velocity:

$$E \alpha \tfrac{1}{2} mV^2$$

This can then be rearranged to:

$$V \alpha (2E/m)_{1/2}$$

To provide an "ideal" generally equal velocity among both small and large mass ions, the kinetic energies of respective ones of the ions should be proportional to their respective masses. Alternatively stated, to match a velocity of a large ion to a velocity of a small ion, the ratio of their respective kinetic energy to mass should be made substantially equal. Thus, more kinetic energy needs to be delivered by the ramp of the potential energy signal adjustment (310) to the larger mass ions than to the lower mass ions. For example, if ions at mass 200 are transferred with 2 eV, ions at mass 2000 should have 20 eV of energy to arrive at the FTICR cell generally at the same time, or with the same separation as they had at the time of ramping at the beginning of $t_2$. However, one drawback of this technique is that the FTICR cell is able to trap only a limited range of kinetic energies (~1 eV), and this would still catch only a narrow range of masses.

Therefore, as described above, according to an aspect of the present invention, optionally in step 460, a system and method to correct for the kinetic energy differences as the ions arrive at the FTICR cell is provided. As ions leave the second segment of the distance D, (that is as they approach the end of the second time period $t_2$), the applied potential energy signal is adjusted again in step 460 by applying a second potential energy signal adjustment (330). Once again, the potential energy signal adjustment (330) may be in the form of a DC offset applied to the long multipole 120*b* of the of the ion transfer optics 120 relative to the second ion trap 130. The second potential energy adjustment in step 460 comprises repeating the adjustment of potential energy signal adjustment to the long multipole 120*b* which initially altered the kinetic energies, so that all the kinetic energies are re-adjusted. Finally, ions are gated into and trapped in the second ion trap 130, step 470, such that substantially all ions enter the second ion trap 130 at substantially the same time.

As mentioned earlier, for the described method to work, ions must have some initial time-of-flight separation when arriving at a portion of the ion transfer optics 120 that is going to have a potential energy adjustment applied to it. Since the ions can be provided with a consistent velocity whilst traveling through the potential energy adjusted ion transfer optics, the m/z dependent separation on exit will be the same as it was at the initial potential energy signal adjustment (310). The overall m/z dependent separation can therefore be significantly reduced. This is particularly so because the last ion optical transfer device (the long multipole 120*b*) is the longest of the ion transfer optical devices, and thus potentially the largest contributor to time-of-flight separations. Ideally, no additional separation will take place during ion transfer through the long multipole 120*b*. However, in reality, the transfer may still exhibit some undesirable m/z dependent separation.

One way of dealing with possible further undesirable m/z dependent separation is by a technique that involves over-modulating during the first potential energy signal adjustment. Over-modulating the kinetic energy of the ions as they enter the potential energy adjusted ion transfer optics 120 can further reduce the remaining separation. This results in the high m/z ions having a higher velocity than the low m/z ions, and a time-of-flight separation that is smaller at an exit than at an entrance of the long multipole 120*b*. This necessitates a faster adjustment of energy at the entrance than the potential energy adjustment required at the exit to properly re-adjust the kinetic energies.

Figure 5:
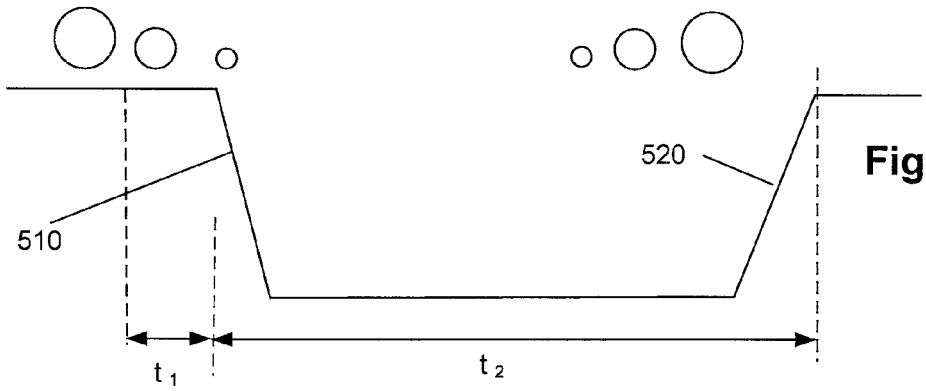
FIG. 5 illustrates another linear potential energy profile along various segments of the mass spectrometer in accordance with another aspect of the present invention.

Another solution is to over-adjust the kinetic energy in an even stronger fashion, with the goal of inverting the time-of-flight separation of ions. The high m/z ions would then exit the ion transfer optics before the low m/z ions. In this aspect of the invention, the potential energy adjustment 320 illustrated in FIG. 3 would be unnecessary in this case, but the exit potential energy adjustment would need to be reversed for proper kinetic energy re-adjustment, as illustrated by the potential energy signal adjustment 520 in FIG. 5. In this particular implementation, the potential energy adjustment 510 would need to be sufficient enough to give the ions of high m/z value a velocity that is actually greater than the ions with a low m/z value. This would enable the ions with a high m/z value to reach the exit end of the ion transfer optics 120 before the ions of a low m/z value. In this case, there would then be sufficient transfer distance between the exit of the ion transfer optics 120 and the entrance 220 of the FTICR cell 130 for normal time-of-flight behavior to take place. If the time-of-flight inversion is executed properly in the long multipole 120*b*, for example, the separation effects will be canceled out by the time-of-flight behavior of the ions that occurs between the long multipole 120*b* and a gate or the entrance 220 of the FTICR, thus allowing all ions to arrive at the FTICR cell at substantially the same time and with the same kinetic energy.

A simple design to implement this method would stop the adjustment of potential energy of the ion transfer optics 120 just inside a bore of the superconducting magnet 125. Once inside the bore, the magnetic field is sufficient to contain the ions axially, thus producing efficient transfer without any electric fields. The long multipole 120*b* could also be separated into two sections with independent DC offsets. In this case, the front section 230 would be used for kinetic energy variation and the second section 240 would have a constant DC offset for standard time-of-flight separation, for example.

Figure 6:
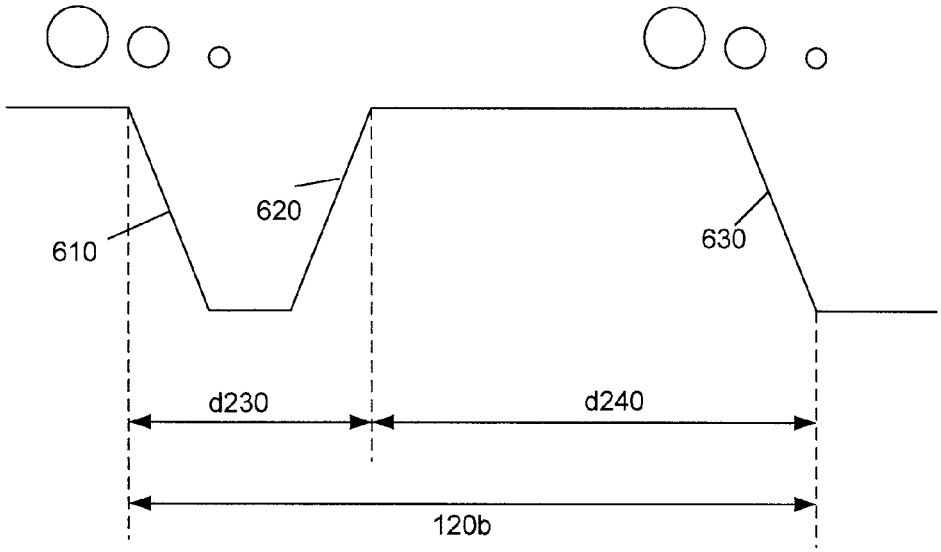
FIG. 6 illustrates yet another linear potential energy profile along various segments of the mass spectrometer in accordance to yet another aspect of the present invention.

FIG. 6 depicts an example of an alternative potential energy profile as applied to the ion transfer optics as the ions traverse the second segment of the distance D. The adjustment in potential energy signal can be achieved by applying a potential energy as ions enter the long ion guide 120*b*, adjusting the potential energy downwards (610). This induces more acceleration for the higher m/z ions than for lower m/z ions, thus providing more kinetic energy to the higher m/z ions than to the lower m/z ions. As discussed above, a desired result of overall ion velocities that are more consistent among all of the ions of interest may be achieved. As indicated earlier, whilst ions are traveling through the long ion guide 120*b*, they are in a field free region and thus offset changes have no effect on kinetic energy. This allows the offset of the ion transfer optics to be adjusted back up (620) to the initial entrance voltage without affecting the ions velocity. If the potential energy adjustment (610) at the entrance of the long multipole 120*b* is performed correctly, ions will have the same velocity in the long ion guide 120*b*, and thus the same travel time across this portion of the ion transfer optics. This means the same potential energy adjustment (610) that was used as ions entered the ion transfer optics long multipole 120*b* can be repeated (630) as ions exit the ion transfer optics. Each ion will then experience a deceleration upon exiting the ion transfer optics long multipole 120*b* that is equal and opposite to the acceleration experienced coming into the ion transfer optics 120*b*. The net effect is the elimination of time-of-flight differences across this portion of the ion transfer optics 120 with no effective variation in kinetic energy.

The methods of the invention can be implemented in digital electronic circuitry, or in computer hardware, firmware, software, or in combinations of them. The methods of the invention can be implemented as a computer program product, i.e., a computer program tangibly embodied in an information carrier, e.g., in a machine-readable storage device or in a propagated signal, for execution by, or to control the operation of, a data processing apparatus, e.g., a programmable processor, a computer, or multiple computers. A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a communication network.

Method steps of the invention can be performed by one or more programmable processors executing a computer program to perform functions of the invention by operating on input data and generating output. Method steps can also be performed by, and apparatus of the invention can be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random-access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in special purpose logic circuitry.

To provide for interaction with a user, the invention can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

The steps of the methods illustrated and described above can be performed in a different order and still achieve desirable results. The disclosed methods and examples are illustrative only and not intended to be limiting. The apparatus illustrated and described can include other components in addition to those explicitly described, which may be required for certain applications. The various features explained on the basis of the various exemplary embodiments can be combined to form further embodiments of the invention.

It should be noted that the technique described herein is not limited for example to only two segments of the distance, but may instead be expanded to three or more segments in which various potential energy variations may be applied. It should be noted that the techniques described herein are not limited for example to potential energy variations that are defined entirely linearly as illustrated, partial or full non-linear potential energy variations may be utilized, including for example variations that can be defined quadratically. It is to be understood that the efficiency benefits realized by the above-described techniques may be even greater in applications where a wider range of mass to charge ratios is employed.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A method of transferring ions from a first ion trap to a second ion trap, the first and second ion trap separated by a distance, the distance including ion optics, and the method comprising the steps of:

ejecting ions from the first ion trap and allowing spatial separation of ions with higher and lower mass to charge ratios over at least a portion of the ion optics, wherein the ion optics include a first and a second ion guide in series, the second ion guide being longer than the first ion guide, the first ion guide being positoned proximate the first ion trap;

applying a mass dependent potential energy signal to the ions after entering one of the two ion guides, such that higher mass to charge ratio ions acquire a higher kinetic energy than the lower mass to charge ratio ions;

allowing the energized ions to traverse from the first to the second trap via the ion optics; and the mass dependent potential energy signal applied being such that substantially all ions enter the second ion trap at substantially the same time, and have substantially the same kinetic energy.

2. The method of claim 1, further comprising the step of:

adjusting the potential energy signal applied to the energized ions before they enter the second ion trap, such that substantially all ions enter the second ion trap at substantially the same time, and have substantially the same kinetic energy.

3. The method of claim 1, wherein:

the adjusting of the potential energy is such that the higher mass ions enter the second ion trap in the same mass order with respect to the lower mass ions, as they were ejected from the first ion trap.

4. The method of claim 1, wherein:

the first ion trap comprises a two dimensional ion trap.

5. The method of claim 1, wherein:

the second ion trap comprises a Fourier Transform Ion Cyclotron Resonance cell.

6. The method of claim 1, wherein:

the application of potential energy is provided by adjusting the electric field associated with the at least one optical elements.

7. The method according to claim 1, wherein:

the voltage on the ion optical element is varied quadratically with time.

8. The method of claim 1, wherein:

the adjustment of energy is provided by altering the voltage of the one of the two ion guides as ions exit.

9. The method of claim 1, wherein:

substantially the same time comprises within a 10 millisecond range.

10. An apparatus for transferring ions from a first ion trap to a second in trap, the first and second ion traps separated by a distance, the distance having a first and a second ion guide, the second ion guide being longer than the first ion guide, the first ion guide being positioned proximate the first ion trap; the apparatus comprising:

a first and a second ion trap, the ion traps separated by a distance, the distance comprising the first and the second segment, the first segment being defined by the time required to allow ions of high mass to charge ratio that have been ejected from the first ion trap to be spatially separated from the ions of low mass to charge ratio; and a mass dependent potential energy variation means which provides a mass dependent potential energy variation to the spatially separated ions such that the higher mass to charge acquire a higher kinetic energy than the lower mass to charge ratio ions, wherein the mass dependent potential energy variation means is applied along the second ion guide.

* * * * *